US010488167B2

(12) United States Patent
Ockfen et al.

(10) Patent No.: US 10,488,167 B2
(45) Date of Patent: Nov. 26, 2019

(54) WEDGE-BASED HEAT SWITCH USING TEMPERATURE ACTIVATED PHASE TRANSITION MATERIAL

(71) Applicant: Raytheon Company, Waltham, MA (US)

(72) Inventors: Alex E. Ockfen, Tucson, AZ (US); Samuel T. Craig, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 357 days.

(21) Appl. No.: 15/419,095

(22) Filed: Jan. 30, 2017

(65) Prior Publication Data

US 2018/0216898 A1 Aug. 2, 2018

(51) Int. Cl.
*F42B 15/34* (2006.01)
*F28F 13/00* (2006.01)

(52) U.S. Cl.
CPC ..... *F42B 15/34* (2013.01); *F28F 2013/008* (2013.01)

(58) Field of Classification Search
CPC ..... F28F 13/00; F28F 2013/005; F28F 2013/006; F28F 2013/008; F42B 15/34; H05K 7/1404; H05K 7/2049; H05K 7/20854
USPC ..... 165/276, 277
See application file for complete search history.

(56) References Cited

U.S. PATENT DOCUMENTS 3,177,933 A 2/1963 Webb
4,273,183 A * 6/1981 Altoz ..... F28F 27/00 165/185
4,304,294 A 12/1981 Reisman et al.
4,687,315 A 8/1987 Fujii
4,771,823 A 9/1988 Chan
4,821,147 A * 4/1989 Jacobs ..... H05K 7/1404 211/41.17
5,535,815 A * 7/1996 Hyman ..... F28F 13/00 165/185
5,859,764 A 1/1999 Davis et al.
6,351,383 B1 * 2/2002 Payton ..... H05K 7/20445 165/80.3
6,404,636 B1 * 6/2002 Staggers ..... H05K 7/1434 165/185

(Continued)

*Primary Examiner* — Christopher R Zerphey
*Assistant Examiner* — Hans R Weiland
(74) *Attorney, Agent, or Firm* — Eric A. Gifford

(57) ABSTRACT

A wedge-based heat switch includes a plurality of wedge segments on a shaft, an energy storage element (e.g., a spring or pressurized cavity) configured to store (and release) energy via compression or expansion of the element along the shaft and a temperature activated phase transition material. A temperature stimulus activates the phase transition material to release the stored energy and move the wedge segments axially along the shaft to expand or contract the plurality of wedge segments. The wedge-based heat switch may be configured as a unidirectional switch, either conductive-to-insulating or insulating-to-conductive, or a bi-directional switch. The specific design of the wedge-based heat switch is informed by such factors as unidirectional or bi-directional, required preloading of a surface, conductance ratio between conducting and insulating states, temperature stimulus, switching speed and form factor.

14 Claims, 11 Drawing Sheets

(56) References Cited

U.S. PATENT DOCUMENTS

| | | | | |
|---|---|---|---|---|
| 6,687,130 | B2 * | 2/2004 | Adams, Sr. | H05K 7/1404 361/174 |
| 6,972,659 | B2 * | 12/2005 | von Behrens | E05B 47/0009 337/139 |
| 7,752,866 | B2 | 7/2010 | Vaidyanathan et al. | |
| 8,477,500 | B2 | 7/2013 | Deng et al. | |
| 8,773,864 | B2 * | 7/2014 | Rapp | H05K 7/1434 361/752 |
| 9,629,232 | B2 * | 4/2017 | Reilly | H05K 1/0201 |
| 10,129,996 | B2 * | 11/2018 | Rozzi | H05K 7/1424 |
| 2007/0253169 | A1 | 11/2007 | Clawser | |

* cited by examiner (ROTATED 90°)

WEDGE-BASED HEAT SWITCH USING TEMPERATURE ACTIVATED PHASE TRANSITION MATERIAL

BACKGROUND OF THE INVENTION

Field of the Invention

This invention relates to heat switches and more particularly to the sub-class of heat switches that are passively activated based on a temperature stimulus and switch rapidly between thermally conductive and thermally insulating states.

Description of the Related Art

As illustrated in FIGS. 1*a* and 1*b*, a heat switch 10 is a device that switches between a thermally conductive state 12 and a thermally insulating state 14 to provide thermal management for electronics and other temperatures sensitive devices between two surfaces 16 and 18. The conductance ratio between the thermally conductive and thermally insulating states being typically at least 10:1, and more preferably at least 50:1, but the need is design specific and lower ratios may still provide useful thermal performance improvements. As illustrated in FIG. 2, a sub-class of heat switches includes those that are passively activated based on a temperature stimulus (e.g., crossing a temperature threshold 20), and exhibit the ability to rapidly switch between the thermally conductive state 12 and thermally insulating state 14 (or vice versa). The term rapid refers to heat switching on the order of seconds to minutes, not minutes to hours, typically less than 1 minute, and most preferably less than 20 seconds when exposed to an extreme temperature environment.

Shape memory heat switches are based on shape memory materials that undergo a solid-state phase change from martensitic to austenitic crystal structure at a prescribed temperature that commonly yields growth or shrinkage of the material by approximately 3-6%. U.S. Pat. No. 7,752,866 uses a shape memory spring to make and/or break thermal contact between two surfaces via the linear spring extension and contraction, with all movement along the same line of motion as the spring action. Similarly, U.S. Pat. No. 6,404,636 uses a shape memory Belleville washer to translate a heat generating device in and out of contact with a heatsink. Here, the entire assembly housing the devices is moveable along the same line of motion as the Belleville washer. The usefulness of this approach is limited in that (1) a conductive thermal path through a solid exists between the hot and cold sides in both the thermally conductive and thermally insulating states [no pure air gap], diminishing the heat switching effect and (2) the mass of the housing to be translated is large in comparison to the spring and much of the spring energy will be required to translate the massive housing against opposing frictional forces (e.g. tracks, alignment features, etc.), diminishing the spring energy available to generate contact pressure at a thermal interface.

Gas-gap heat switches operate by maintaining a small gap between two components (<=1-mil). In the thermally conductive state, heat transfer between components occurs via gas-gap conduction and radiation. Evacuation of the gas between the two components using a temperature activated sorbent material switches the device to a thermally insulating state, limiting the heat transfer mode to pure radiation. An example of a gas-gap heat switch is disclosed in U.S. Pat. No. 4,771,823. Gas-gap devices provide a passive, temperature activated, heat switching means, but require extremely tight tolerances and up to an hour to passively switch between states.

Differential thermal expansion devices leverage the differences in the coefficient of thermal expansion of two different materials to make and/or break thermal contact between components at a prescribed activation temperature. This is commonly achieved using bimetallic strips that exhibit a deflection with change in temperature. U.S. Pat. Nos. 3,177,933 and 4,304,294 both utilize bimetallic strips to achieve a heat switching mechanism. The simple fact that common materials deflect by millionths of an inch per degree temperature change require these devices to either be of a very large size (and thus slow responding) or be exposed to extreme temperature differences.

A wedge-based mechanical locking mechanism or "wedgelock" 30 is illustrated in FIGS. 3*a* (locked) and 3*b* (unlocked). Wedgelock 30 comprises a shaft 32, a plurality of wedge segments mounted on the shaft with one wedge segment 34 pinned via pin 35 to the end of the shaft and the remaining wedge segments 36 configured such that they can move with respect to each other, and a fastener 38 that threads into the shaft from the non-pinned end and seats on a fixed shoulder 40 of the final wedge segment. Applying torque to fastener 38 moves (contracts) the plurality of wedge sections in the axial direction along the shaft, forcing at least one wedge segment to move (expand) radially (e.g., perpendicular to the axial motion) to provide a mechanical locking force between two surfaces 42, 44 perpendicular to the axis of the shaft. The mechanical locking force between the two adjacent surfaces 42, 44 is achieved using axial contraction of the shaft 32 and fastener 38 to redistribute the axial load into a radial load between the surfaces of the wedge segments 34, 36 and the adjacent surfaces 42, 44. Thus, the conventional wedge-based mechanical locking mechanism serves as fixed mechanical interface between two adjacent surfaces. Existing wedge-based mechanical locking mechanisms emphasize a single and consistent form-factor that is specific to standardized tray-mounted electronics.

U.S. Patent Pub. No. 2007/0253169 entitled "Wedgelock Device for Increased Thermal Conductivity of a Printed Wiring Assembly" includes at least one wedge segment that is configured to move at an acute angle with respect to another wedge segment to secure a printed wiring board in the slot of a heat sink chassis. The wedgelock device provides improved thermal performance by creating additional thermal paths from the printed wiring board to the heat sink chassis. This is accomplished by forming the top and bottom surfaces of the wedge segments with a trapezoidal shape instead of the conventional rectangular shape in which the wedge segment moves perpendicular to the other wedge segments and axis of the shaft.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a passive temperature activated heat switch that switches rapidly between a thermally conductive state and a thermally insulating state. A wedge-based heat switch includes an energy storage element (e.g., a spring or pressurized cavity) configured to store (and release) energy via compression or expansion of the element along the shaft and a temperature activated phase transition material. A temperature stimulus activates the phase transition material to release the stored energy and move wedge segments axially along a shaft to expand or contract and move radially to switch between thermally conducting and thermally insulating states. The wedge-based heat switch may be configured as a unidirectional switch, either conductive-to-insulating or insulating-to-conductive, or a bi-directional switch. The specific design of the wedge-based heat switch is informed by such factors as unidirectional or bi-directional, required preloading of a surface, isolation between conducting and insulating states, temperature stimulus, switching speed and form factor.

The wedge-based heat switch is comprised of three primary components. A plurality of wedge segments is aligned on a shaft to enable the mechanism to transmit axial contraction or expansion along the axis of the shaft into radial displacement of the wedge segments to make and/or break thermal contact between two surfaces to define thermally conductive and thermally insulating states. A phase transition material is employed to passively switch the state of the heat switch based on a prescribed temperature stimulus (e.g., crossing a temperature threshold). This phase transition material holds the switch in an initial state until the activation temperature is reached, at which time the phase transition material is physically altered, holding the switch in the opposite state (or vice versa). The phase transition material can take multiple embodiments (e.g. shape memory, controlled melt material, temperature-dependent adhesive) and provide either unidirectional switching (passive release) or repeatable bidirectional switching (passive displacement change). An energy storage element (e.g., a spring or pressurized cavity) stores the energy necessary to move the wedge segments axially to contract or expand the plurality of wedge segments, and exert this force upon activation of the phase transition material to achieve the desired heat switching effect.

In an embodiment, a wedge-based heat switch is configured as a conductive-to-insulating unidirectional switch. A fastener is subjected to mechanical preload causing internal stress in the fastener to create an axial force. A small portion of this axial force serves to overcome the compression of an energy storage element such as a light spring acting between the shaft and final wedge segment. The majority of this axial force is used to load the wedge segments, which translate the force into the radial direction to apply the force to the surfaces to be thermally connected, creating contact pressure at the interfaces and providing the thermally conductive state. The mechanical preloading is acting between the interfaces, and a shoulder region within the heat switch, which serves as a bearing surface to react the mechanical preload of the fastener. Upon activation of the phase transition material, the bearing surface no longer carries load and the fastener becomes unstressed, eliminating the axial force loading the wedge segments. The compression force in the energy storage element now causes the wedges to axially expand, contracting radially such that an air gap is created between the surfaces to form the thermally insulating state.

In an embodiment, a wedge-based heat switch is configured as an insulating-to-conducting unidirectional switch. A fastener is subjected to mechanical preload causing internal stress to create an axial force that is used to axially expand the wedge segments. All of this force is used to extend a heavy spring acting between the shaft and final wedge segment within the heat switch, putting it in tension. The mechanical preloading is acting within the heat switch to extend the spring and does not load the wedges nor interfaces. A shoulder region within the heat switch serves as a bearing surface to react the mechanical preload of the fastener. Upon activation of the phase transition material, the bearing surface no longer carries load and the fastener becomes unstressed, eliminating the axial force holding the energy storage element in tension. The axial tension force in the energy storage element (e.g., heavy spring) now loads the wedge segments. The wedge segments axially retract, closing the radial gap, and the spring force loading is translated into the radial direction to apply the force to the surfaces to be thermally connected, creating contact pressure at the interfaces. Since the spring in this configuration is responsible for the exertion of forces upon the interfaces, it is thermally advantageous here to use a heavy spring.

In an embodiment, a wedge-based heat switch is configured as a bi-directional switch. A pair of energy storage elements such as springs is employed that are in equilibrium with the wedge segments expanded so that the air gap is maintained between the interfaces to be thermally connected. Upon activation of the phase transition material, the energy storage element that applies axial force acting in the direction that loads the wedges becomes dominant. A small portion of the dominant spring force serves to overcome the compression of the opposing spring. The majority of this axial force from the dominant energy storage element is used to load the wedges, which translate the force into the radial direction to apply it to the surfaces to be thermally connected, creating contact pressure at the interfaces. In an embodiment, one or both of the energy storage elements are formed in part from the phase transition material. In an embodiment, one or both of the energy storage elements are springs.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a passive temperature activated heat switch that switches rapidly between a thermally conductive state and a thermally insulating state, vice-versa or both. A wedge-based heat switch includes an energy storage element (e.g., a spring or pressurized cavity) configured to store (and release) energy via compression or expansion of the element along the shaft and a temperature activated phase transition material. A temperature stimulus activates the phase transition material to release the stored energy and move wedge segments axially along a shaft to expand or contract and move radially to switch between the thermally conducting and thermally insulating states. The wedge-based heat switch may be configured as a unidirectional switch, either conductive-to-insulating or insulating-to-conductive or a bi-directional switch. The specific design of the wedge-based heat switch is informed by such factors as unidirectional or bi-directional, required preloading of a surface, isolation between conducting and insulating states, temperature stimulus, switching speed and form factor.

Figure 1A:
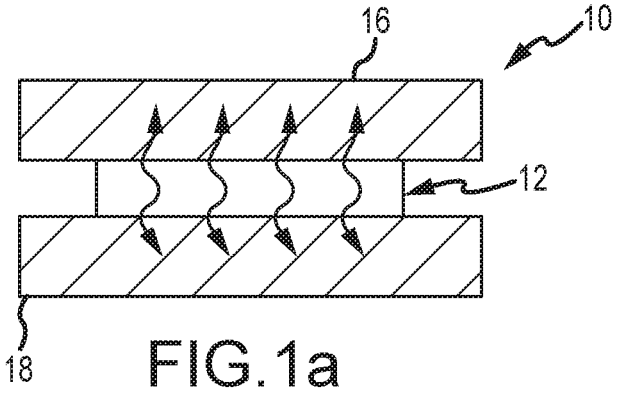
FIG.1a (PRIOR ART)
FIGS. 1*a* and 1*b*, as described above, illustrate a heat switch in its thermally conductive and thermally insulating states, respectively.
Figure 1B:
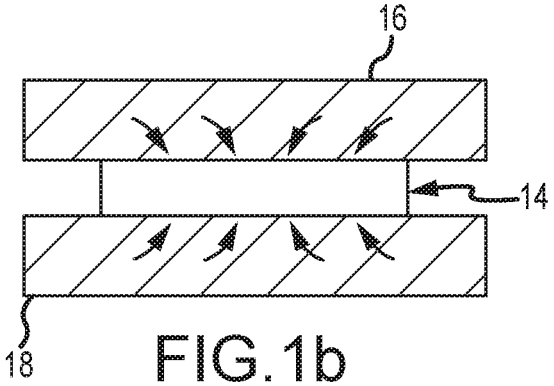
FIG.1b (PRIOR ART)
Figure 2:
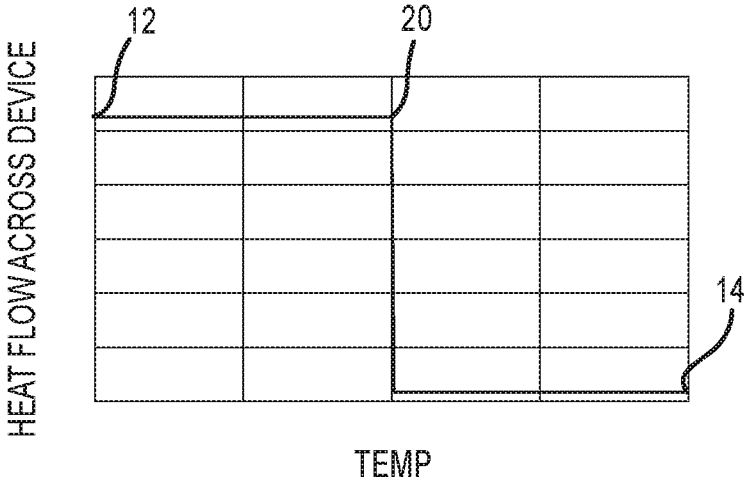
FIG.2 (PRIOR ART)
FIG. 2, as described above, illustrates the rapid switching of a passive temperature activated heat switch.
Figure 3A:
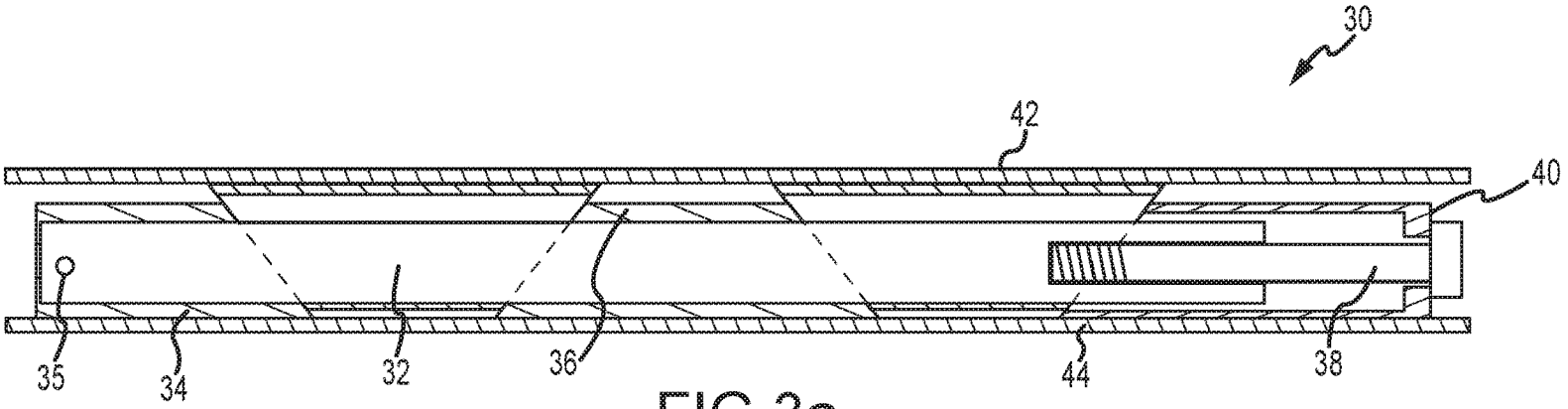
FIG.3a (PRIOR ART)
FIGS. 3*a* and 3*b*, as described above, illustrate a conventional wedgelock device.
Figure 3B:
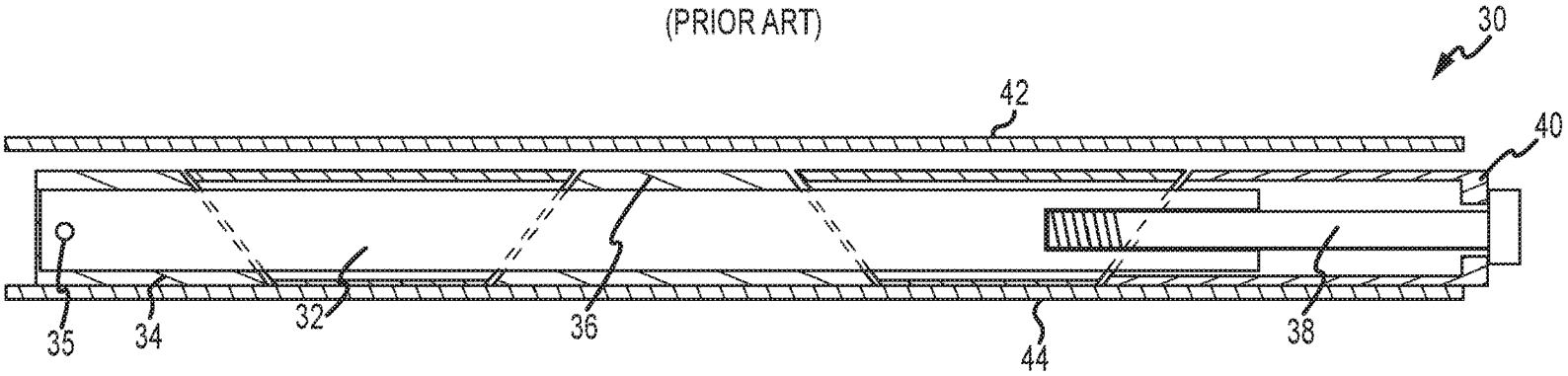
FIG.3b (PRIOR ART)
Figure 4:
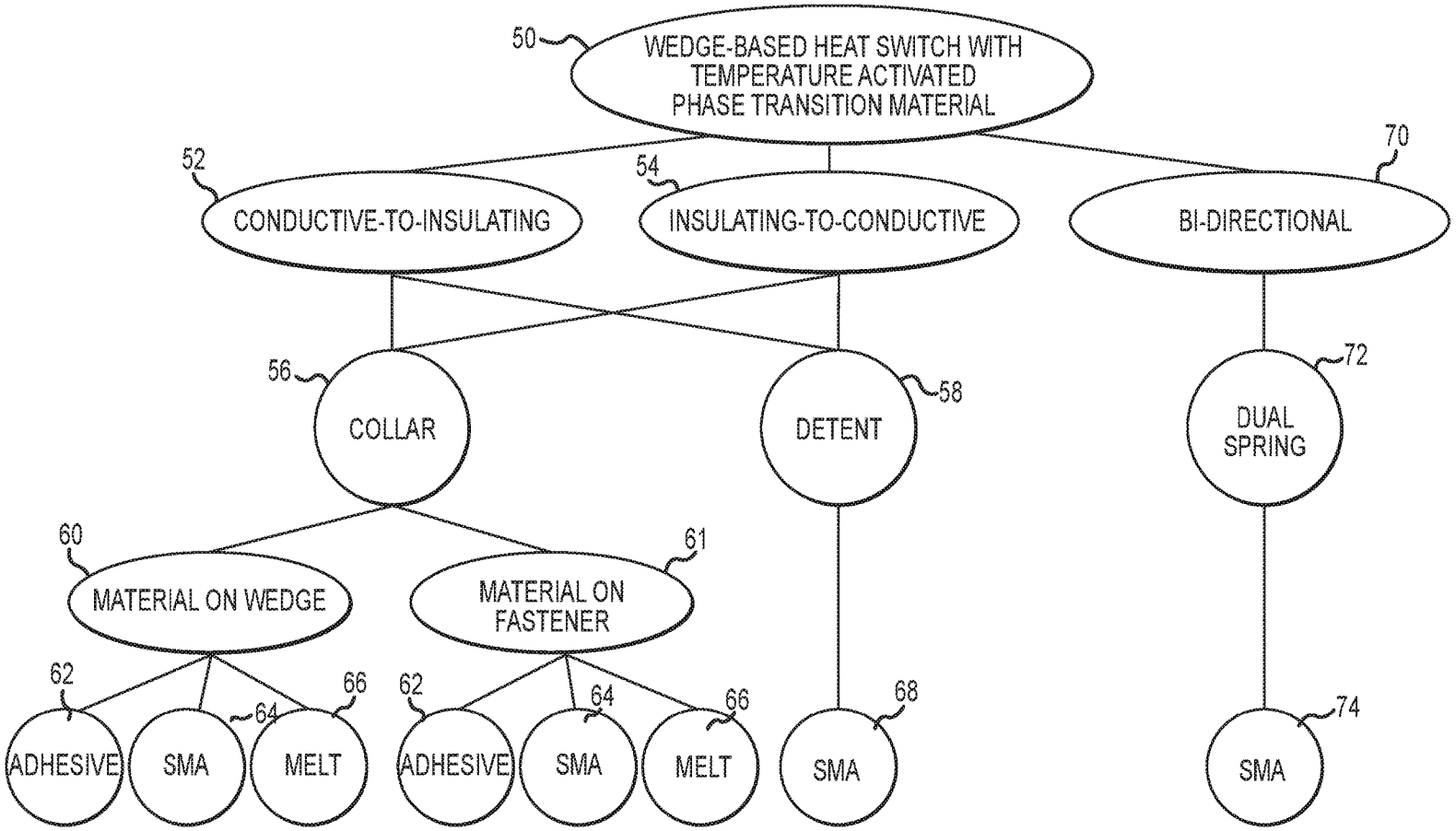
FIG. 4 is a diagram illustrating multiple exemplary embodiments of a wedge-based heat switch using temperature activated phase transition material in accordance with the invention for the sub-class of passive temperature activated heat switches.

Multiple exemplary embodiments of a passive wedge-based heat switch 50 using temperature activated phase transition material in accordance with the invention for the sub-class of passive temperature activated heat switches are illustrated in FIG. 4. These embodiments are merely illustrative of the principles embodied in the wedge-based heat switch and not intended to constitute an exhaustive list of such embodiments. Without loss of generality the energy storage element is depicted as a spring or springs in the illustrated embodiments. Other energy storage elements configured to store (and release) energy through compression or expansion along an axis may be used as well.

Wedge-based heat switch 50 is comprised of three primary components. A plurality of wedge segments is aligned on a shaft to enable the mechanism to transmit axial contraction or expansion along the axis of the shaft into radial displacement of the wedge segments to make and/or break thermal contact between two surfaces to define thermally conductive and thermally insulating states. A phase transition material is employed to passively switch the state of the heat switch based on a prescribed temperature stimulus (e.g., crossing a temperature threshold). This phase transition material holds the switch in an initial state until the activation temperature is reached, at which time the phase transition material is physically altered, holding the switch in the opposite state (or vice versa). The phase transition material can take multiple embodiments (shape memory, controlled melt solder, temperature-dependent adhesive) and provide either unidirectional switching (passive release) or repeatable bidirectional switching (passive displacement change). One or more energy storage elements (e.g., a spring or pressurized cavity) are configured to store (and release) energy via stretching or compression of the element along the shaft necessary to move the wedge segments axially to contract or expand the plurality of wedge segments, and exert this force upon activation of the phase transition material to achieve the desired heat switching effect. The energy storage element is generally capable of storing potential energy by either stretching or compressing. Controlled release of the stored potential energy yields a force that acts to cause a change in length of the element. In an embodiment, a coil spring stores elastic potential energy. In another embodiment, a pressurized cavity stores potential energy in the form of an increased pressure that can be released to change the length of the pressurized cavity.

The heat switch includes several features common to all wedge segments. Each has a bore through which the shaft passes and they slide freely along the axis of this shaft unless or until mechanically restrained. Each includes an angled surface on one or two sides. The angled surfaces between segments come into contact with each other when the segments are contracted along the shaft and radial displacement is produced. The first wedge segment is pinned to the end of the shaft, mechanically constraining it from ever moving axially. The final wedge segment includes additional features that are discussed below and highlighted in the figures. Various details of the wedge segments are design dependent. Those include but are not limited to: (i) wedge material, (ii) angle of the angled surfaces, (iii) height in the radial direction, (iv) width in the out of plane direction. Additionally, the wedge cross sections viewed from the perspective of the axial shaft (down the shaft) may be curved or flat. That is, the two adjacent surfaces that the heat switch serves to connect or insulate may be curved or flat.

In an embodiment, a wedge-based heat switch is configured as a conductive-to-insulating unidirectional switch 52. A fastener is subjected to mechanical preload causing internal stress to create an axial force. A small portion of this axial forces serves to overcome the compression of a light spring of this axial force is used to load the wedge segments, which translate the force into the radial direction to apply the force to the surfaces to be thermally connected, creating contact pressure at the interfaces and providing the thermally conductive state. The mechanical preloading is acting between the interfaces, and a shoulder region within the heat switch, which serves as a bearing surface to react the mechanical preload of the fastener. Upon activation of the phase transition material, the bearing surface no longer carries load and the fastener becomes unstressed, eliminating the axial force loading the wedge segments. The compression force in the spring now causes the wedge segments to axially expand, contracting radially such that an air gap is created between the surfaces to form the thermally insulating state.

In an embodiment, a wedge-based heat switch is configured an insulating-to-conducting unidirectional switch 54. A fastener is subjected to mechanical preload causing internal stress to create an axial force, which is used to axially expand the wedge segments. All of this force is used to extend a spring acting between the shaft and final wedge segment within the heat switch, putting it in tension (expansion of a spring places it in tension). The mechanical preloading is acting within the heat switch to extend the spring and does not load the wedge segments nor interfaces. A shoulder region within the heat switch serves as a bearing surface to react the mechanical preload of the fastener. Upon activation of the phase transition material, the bearing surface no longer carries load and the fastener becomes unstressed, eliminating the axial force holding the spring in tension. The axial tension force in the spring now loads the wedges. The wedge segments axially retract, closing the radial gap, and the spring force loading is translated into the radial direction to apply it to the surfaces to be thermally connected, creating contact pressure at the interfaces. Since the spring in this configuration is responsible for the exertion of forces upon the interfaces, it is thermally advantageous here to use a heavy spring.

In various embodiments of either unidirectional switch, the shape transition material may be formed as a "collar" 56 or a clip to engage a "detent" 58 to form a "switchable shoulder region" to store and then release spring energy. The shape transition material may be configured to form other similar structural elements to perform the same or equivalent function. To implement "collar" 56, the shape transition material may be configured in a "material on wedge" 60 or "material on fastener" 61 form factor. In these form factors the shape transition material may be, for example, temperature-dependent adhesive 62, shape memory alloy (SMA) 64 or controlled melt material 66. Other materials that are passively activated by a temperature stimulus to change phase may also be employed. The clip to engage "detent" 58 is suitably formed of a SMA 68.

Heat switch triggering is achievable via the use of phase transition materials that passively exhibit a phase transition as a function of temperature. Three material types are identified that can be interchangeably applied to achieve the desired effect. Shape memory alloys (SMAs) experience a solid-to-solid phase change at a prescribed temperature that commonly yields a 3-6% growth or shrinkage of the material. The material growth and/or shrinkage can be used as a means for achieving actuation and/or a passive release mechanism. Shape memory alloys are available with activation temperatures between −65° C. to +200C. Adhesive materials or "glues" exist that maintain their adhesive properties up to temperatures varying from approximately 50° C. to 200° C. The failure of adhesive at a prescribed temperature provides a mechanism that can be leveraged for as a passive release mechanism for the heat switch invention described in this document. Controlled melt materials, such as solders, exist with tight melt temperature ranges that can be tuned to desired melt temperatures between tens and hundreds of degrees Celsius. In the solid state these materials serve as a means to attach two materials together below the melt temperature. Once the melt temperature is exceeded, the attachment material will liquefy and provide the desired passive release mechanism for the heat switch inventions described in this document.

In an embodiment, a wedge-based heat switch is configured as a bi-directional switch 70. In a dual-spring embodiment 72, a pair of springs is employed that are in equilibrium with the wedges expanded so that the air gap is maintained between the interfaces to be thermally connected. Upon activation of the phase transition material, the spring that applies axial force acting in the direction that loads the wedges becomes dominant. A small portion of the dominant spring force serves to overcome the compression of the opposing spring. The majority of this axial force from the dominant spring is used to load the wedges, which translate the force into the radial direction to apply it to the surfaces to be thermally connected, creating contact pressure at the interfaces. In an embodiment, one or both of the springs is formed of a SMA 74.

The wedge-based heat switch is configured to address a number of requirements and desirable attributes of a heat switch. These includes (1) create high contact pressure, e.g., at least 40 psi and preferably at least 100 psi, at a thermal interface in the thermally conductive state to maximize heat transfer, (2) maximize contact area at the thermal interface in the thermally conductive state to maximize heat transfer, (3) create a stand-alone device whose form-factor can be readily adjusted to drop-in to multiple products/applications, (4) minimize mass/volume to enable use in space/aircraft applications, (5) use a passive heat switching trigger that is highly reliable and does not require external support such as electronic circuitry to operate, (6) switch between the thermally conductive and thermally insulated states rapidly e.g., in less than a minute, (7) adaptable to applications that require both unidirectional (one-way) and bidirectional (two-way) operation. In addition, other fundamental parameters affect how the switch is implemented. The parameters include but are not limited to (1) activation temperature, (2) preciseness of activation temperature, (3) fastener preload (based on how much interface pressure is needed and could affect material selection), (4) wedge material and geometry affecting the cross sectional area normal to heat flow (based on needed performance when thermally connected) and (5) wedge radial height and wedge angles (based on needed performance when thermally insulated), which affects the size air gap size and the amount of fastener preload that gets translated into interface pressure.

Figure 5B:
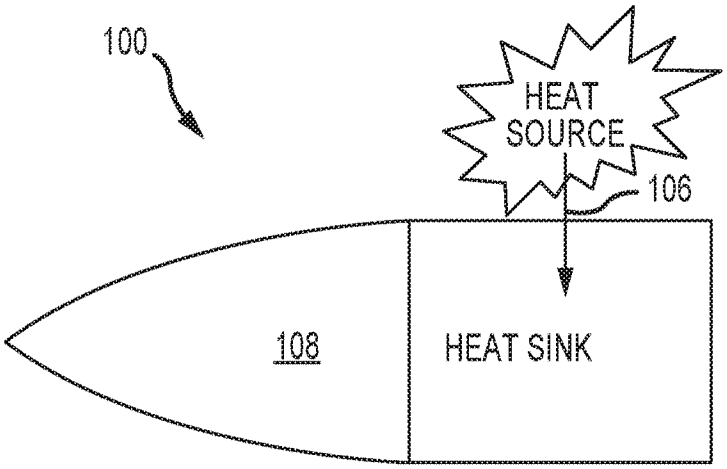
FIGS. 5*a* and 5*b* are drawing of a missile during pre-flight and flight that require a conducting-to-insulating heat switch to sink internal electronics to the airframe and to isolate the electronics from the airframe, respectively.
Figure 5A:
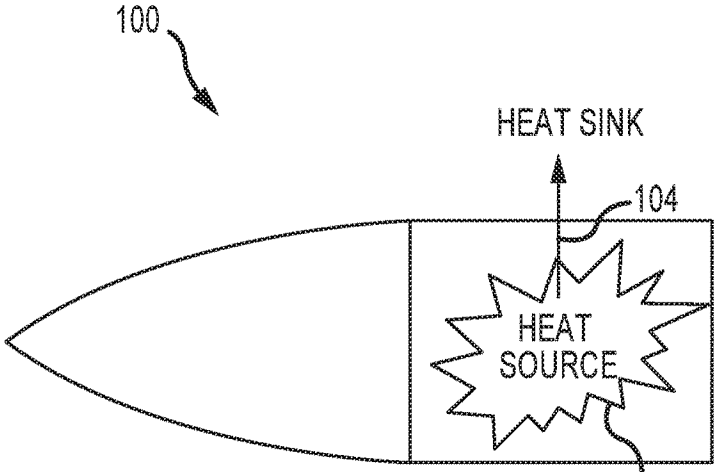
Figure 6A:
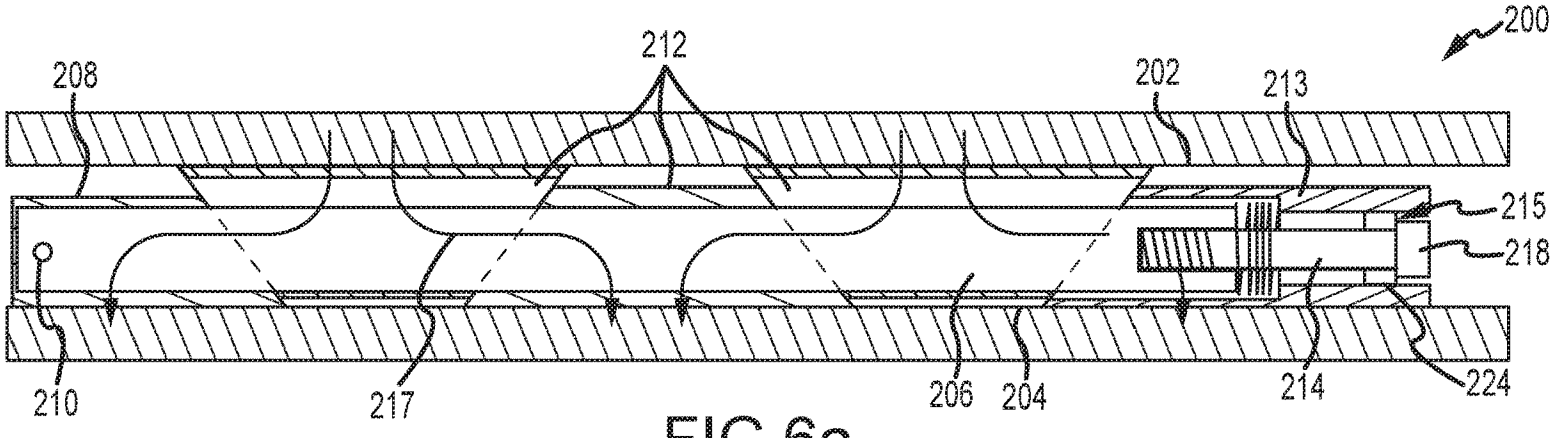
FIGS. 6*a* and 6*b* and 7*a* and 7*b* are sectional side and end views of an embodiment of a conducting-to-insulating heat switch in thermally conducting and thermally insulating states, respectively.
Figure 6B:
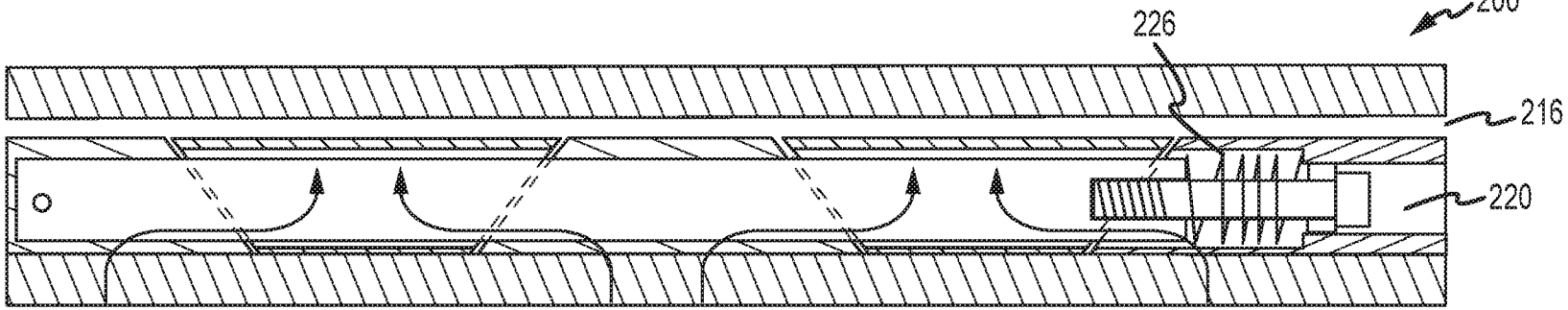

As illustrated in FIGS. 5*a*-5*b*, a supersonic missile 100 operates in an environment in which a heat source 102 e.g., electronics requires efficient removal of heat 104 prior to launch ("pre-flight"). After launch and during "flight", the electronics require thermal isolation from a heat source 106 such as the high heating loads of supersonic flight on airframe 108. A conducting-to-insulating unidirectional heat switch would provide a thermally conducting path from electronics 102 to airframe 108 to sink heat 104 "pre-flight". As the airframe heats up during "flight" the heat switch would rapidly switch to a thermally insulating state to isolate electronics from airframe 108 and heat source 106.

Referring now to FIGS. 6*a*-6*b* and 7*a*-7*b*, an embodiment of a wedge-based heat switch 200 is configured as "conducting-to-insulating", "collar", "material on wedge" and "SMA" from FIG. 4. Wedge-based heat switch 200 is configured to make thermal contact between a first surface or structure 202 (e.g., heat generating electronics) and a second surface or structure 204 (e.g., a missile airframe) to provide a thermally conductive initial state to, for example, sink heat from the electronics to the airframe during "pre-flight". The wedge-based heat switch 200 is further configured to break thermal contact upon application of a temperature stimulus (e.g., heating of the airframe above a threshold temperature) to provide a thermally isolated state to, for example, isolate the electronics from aeroheating of the airframe during "flight".

Wedge-based heat switch 200 comprises a shaft 206, a plurality of thermally conductive wedge segments (e.g., aluminum or copper) mounted on the shaft with one wedge segment 208 pinned via pin 210 to the end of the shaft and the remaining interior wedge segments 212 and a final wedge segment 213 configured such that they can move with respect to each other, and a fastener 214 that threads into the shaft from the non-pinned end and seats on a switchable shoulder region 215 of the final wedge segment 213. The remaining interior and final wedge segments may, for example, have a longitudinal bore that allows them to move axially along shaft 206. The longitudinal bore may, for example, be oversized to allow movement of the wedge segments in a radial direction (e.g. perpendicular, acute angle, curved surface). In an expanded state, all of the wedge segments are suitably positioned in thermal contact with second surface or structure 204 leaving a thermally insulating air gap 216 between the wedge segments and first surface or structure 202 or vice-versa. In a contracted state, every other wedge segment is forced in the radial direction to make contact with the opposing surface to create a thermally conducting path 217 through the wedge segments between the surfaces or structures.

A head 218 of the fastener fits into a bore 220 in the final wedge segment and the fastener threads into the shaft. The shoulder region 215 of the final wedge segment 213 provides a bearing surface as the fastener is loaded, resulting in an axial force applied to the final wedge segment that is directed toward the pinned end of the shaft. The shoulder region 215 is comprised of a shape memory alloy that forms a collar 224, which is initially radially oversized for the bore such that collar 224 is rigidly held in its axial position by way of an interference fit with the inside of the bore as best shown in FIG. 7*a*.

As the fastener load is applied a spring 226 positioned between the shaft 206 and final wedge segment 213 is compressed resulting in an axial force applied to the final wedge segment that is directed away from the pinned end of the shaft. The final wedge segment is attached to second surface 204, which is subject to the external thermal environment, and the interference fit of the shape memory alloy ensures minimal thermal contact resistance to the final wedge segment as best shown in FIG. 7*a*. As a result the thermal time constant of the trigger mechanism is small resulting in fast response to environmental changes.

Figure 7B:
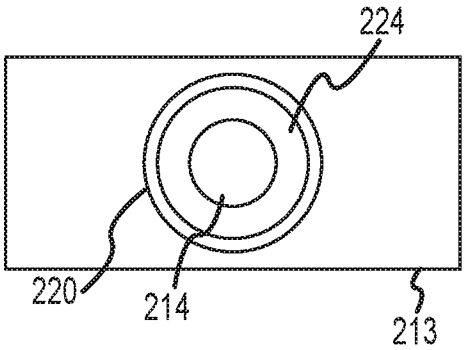
Figure 7A:
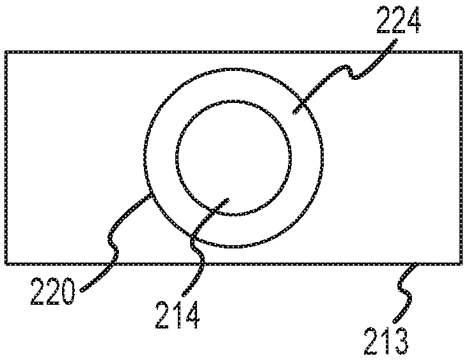
Figure 8A:
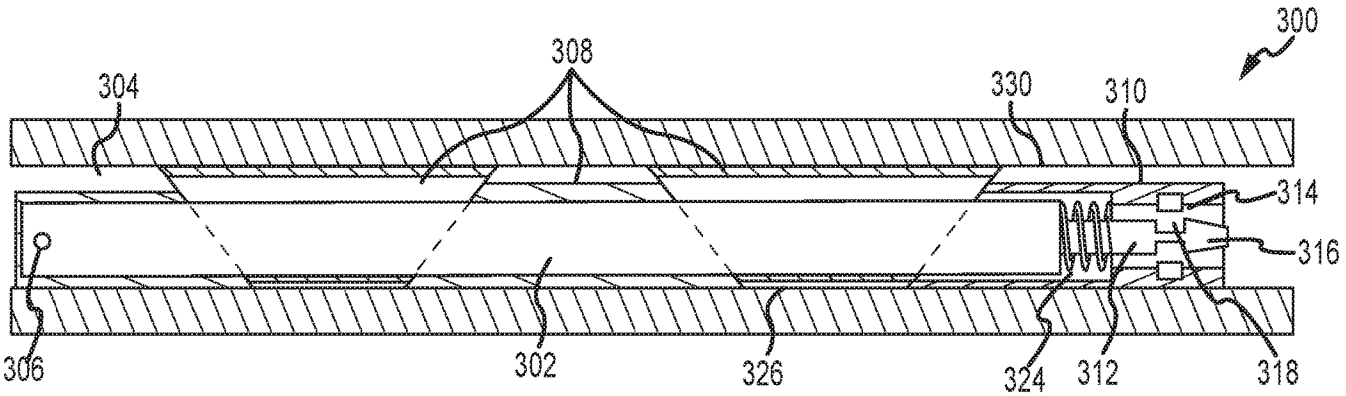
FIGS. 8*a*-8*c* and 9*a* and 9*b* are sectional side and end views of another embodiment of a conducting-to-insulating heat switch in thermally conducting and thermally insulating states, respectively.
Figure 8B:
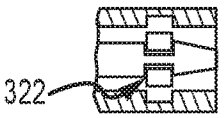
Figure 8C:
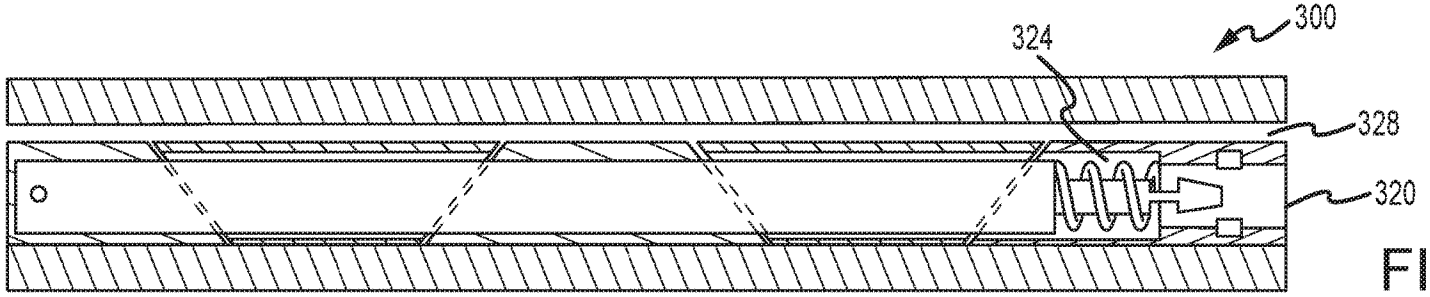
Figure 9B:
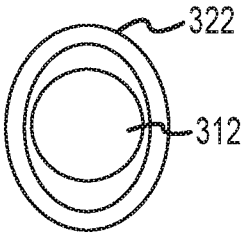
Figure 9A:
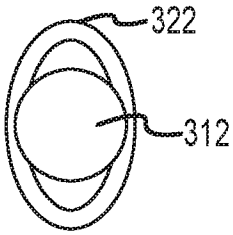

At the specified solid-solid phase change temperature, the shape memory alloy collar 224 contracts away from the bore 220 and towards the fastener 214 as best shown in FIG. 7*b*. This allows the collar 224 to shift freely in axial position within the bore, removing the bearing surface and fastener mechanical load. The axial force directed towards the pinned end is thus eliminated, which allows the compressed spring 226 to axially expand the wedge segments enabling radial relaxation of all wedges to form thermally insulating air gap 217 to the first surface 202.

Two alternative methods to form the switchable shoulder region 215 are identified. First, a material may be installed into the bore 220 in the final wedge segment 213 (e.g., brazed in) that has a lower melting temperature than the wedge segment such that at the specified temperature the material undergoes a solid-liquid phase transition and the melting or softening deletes the fastener bearing surface and again the wedge segments move freely, the compressed spring promotes expansions, and the wedge segments relax to form a gap to the structure. The second alternative is to bond the shoulder region material into the wedge bore using an agent that undergoes a solid-liquid phase transition but the shoulder material does not. Sufficient softening or melting of the bonding material occurs such the wedge expansion again ensues.

In an alternative formulation, the phase change material is employed such that it is initially in intimate contact with fastener 214 or constructed as part of the fastener. The three above methods (i.e., shape memory alloy as shoulder, melting material as shoulder, melting attachment material) again may be utilized. Here, a permanent shoulder exists inside the bore of the final wedge segment. Either part of the fastener itself (e.g., the head of the fastener is the 'material', or the 'material' is used to bond the head to the fastener shank, or the entire fastener itself is made of the 'material'), or an intermediate device between the fastener-shoulder bearing surface (e.g., a washer) employs the material. Upon phase change the fastener load is again removed and wedge expansion ensues.

Referring now to FIGS. 8*a*-8*c* and 9*a*-9*b*, an embodiment of a wedge-based heat switch 300 is configured as "conducting-to-insulating", "detent", and "SMA" from FIG. 4.

Wedge-based heat switch 300 comprises a shaft 302, a plurality of thermally conductive wedge segments mounted on the shaft with one wedge segment 304 pinned via pin 306 to the end of the shaft and the remaining interior wedge segments 308 and a final wedge segment 310 configured such that they can move with respect to each other, and a fastener 312 that threads into the shaft from the non-pinned end and seats on a recessed shoulder region 314 of the final wedge segment 310.

A head 316 of the fastener is manufactured with or without tapering at the free end, and includes a recessed land region that forms the detent 318. The fastener may be integral to the shaft 302 or an attachment to it. The fastener fits into a bore 320 in the final wedge segment. A shape memory alloy expandable spring clip 322 is located in the recessed shoulder region 314 of the final wedge segment. The final wedge segment 310 is manually forced toward the pinned end of the shaft and the spring clip 322 expands to allow the pin end to pass through until the spring clip 322 locks into the fastener detent 318. A spring 324 installed between the shaft 302 and final wedge segment 310 is compressed resulting in an axial force applied to the final wedge segment that is directed away from the pinned end of the shaft. A resultant force from the engaged spring clip 322 acts on the final wedge segment directed toward the pinned end of the shaft. The final wedge segment is attached to a surface or structure 326 that is subject to the external thermal environment, and spring clip 322 maintains contact with the segment pre- and post-shape change. At the specified solid-solid phase change temperature, the shape memory alloy spring clip 322 expands such that it disengages from the fastener 312 and is thereby allowed to shift freely in axial position within the bore. The compressed spring 324 is free to axially expand the wedges enabling radial relaxation of all wedges to form a gap 328 to a second surface or structure 330.

In an "Insulating-to-Conductive", "detent", and "SMA" configuration, the final wedge segment is manually forced away from the pinned end of the shaft until the spring clip locks into the fastener detent. A spring installed between the shaft and final wedge segment was extended by this action and hence out into tension. This spring extension results in an axial force applied to the final wedge segment that is directed toward the pinned end of the shaft. A resultant force from the engaged spring clip acts on the final wedge segment directed away from the pinned end of the shaft. Upon reaching the activation temperature, the solid-solid phase change yields a shape change in the alloy and the shape memory alloy spring clip expands such that it disengages from the fastener and is thereby allowed to shift freely in axial position within the bore. The extended spring is free to axially retract, enabling the wedging action to close the gap to the structure.

Figure 10A:
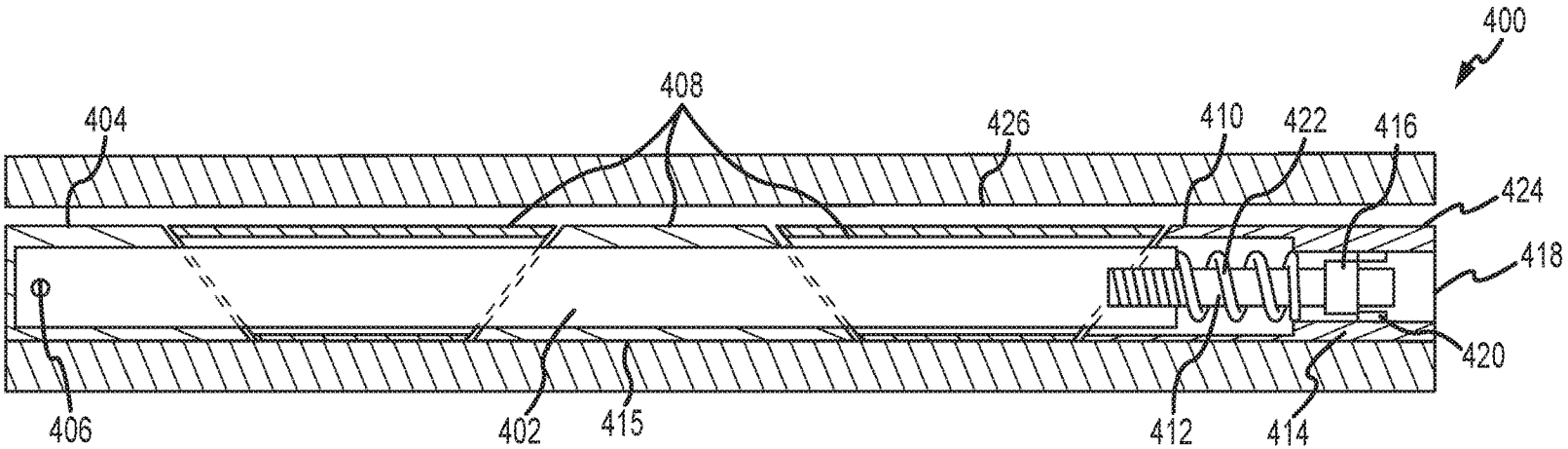
FIGS. 10*a* and 10*b* are sectional side of an embodiment of an insulating-to-conducting heat switch in thermally insulating and thermally conducting states, respectively.
Figure 10B:
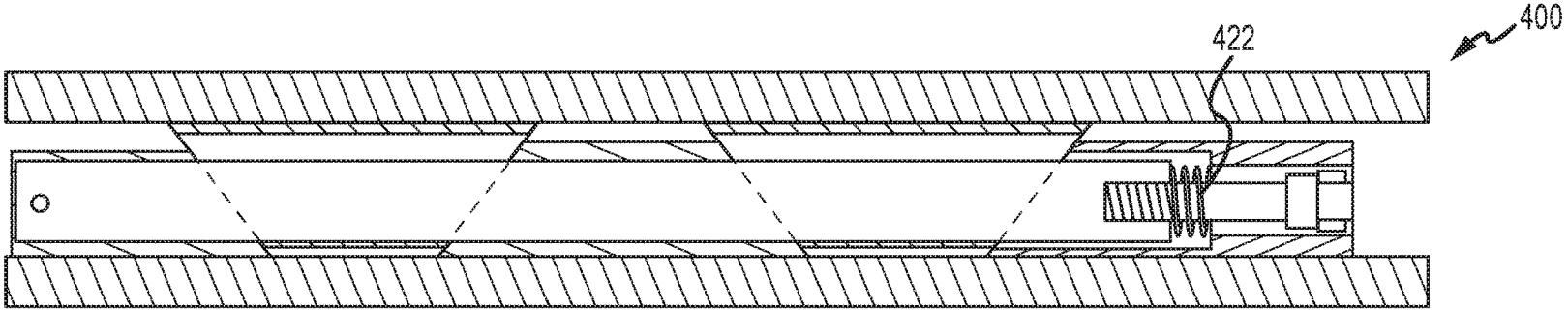

Referring now to FIGS. 10*a*-10*b*, an embodiment of a wedge-based heat switch 400 is configured as "insulating-to-conductive", "collar", "material on wedge" and "SMA" from FIG. 4. This type of switch may be used with electronics that operate within extreme cold environments. The use of self-generated heat is often required to maintain devices above low temperature limits, yet a mechanism is also needed which creates an abrupt increase in thermal conductance as a protective measure. This may be used to avoid thermal shutdown (where a built-in thermal shutdown mode exists but the system is mission critical and cannot power-down as protection) or temperature-induced damage.

Wedge-based heat switch 400 comprises a shaft 402, a plurality of thermally conductive wedge segments mounted on the shaft with one wedge segment 404 pinned via pin 406 to the end of the shaft and the remaining interior wedge segments 408 and a final wedge segment 410 configured such that they can move with respect to each other, and a fastener 412 that threads into the shaft from the non-pinned end and seats on a shoulder region 414 of the final wedge segment 410. In an initial expanded state, all of the wedge segments are in thermal contact with a first surface or structure 415.

A head 416 of the fastener fits into a bore 418 in the final wedge segment 410 and threads into the shaft 402. The shoulder region 414 of the final wedge segment provides the bearing surface as the fastener is loaded. In loading, the fastener is drawn away from the pinned end of the shaft and bears up against the shoulder region 414 on its side that faces the pinned end of the shaft. The result is an axial force applied to the final wedge segment 410 that is directed away from the pinned end of the shaft. In the figure, the shoulder region is comprised of a shape memory alloy collar 420 that is initially radially oversized for the bore 418 such that the collar 420 is rigidly held in its axial position by way of the interference fit. As the fastener load is applied a spring 422 installed between the shaft 402 and final wedge segment 410 is extended into tension resulting in an axial force applied to the final wedge segment that is directed toward the pinned end of the shaft. In this expanded state, the wedge segments are held in thermal contact with first surface or structure 415 to create an air gap 424 between the structure and a second surface or structure 426

At the specified solid-solid phase change temperature, the shape memory alloy collar 420 contracts away from the bore 418 and towards the fastener 412. This allows the alloy to shift freely in axial position within the bore, removing the bearing surface and fastener mechanical load. The axial force directed away from the pinned end is thus eliminated, which allows the extended spring to axially retract, enabling the wedging action to close the air gap 424 to the second surface or structure 426.

Two alternative methods to form the adaptive shoulder region are identified. First, a material may be installed into the bore in the final wedge segment (multiple ways, e.g., brazed in) which has a lower melting temperature than the wedge such that at the specified temperature the material undergoes a solid-liquid phase transition and the melting or softening deletes the fastener bearing surface and again the wedges move freely, the extended spring promotes axial retraction, and the radial gap to the structure is closed. The second alternative is to bond the shoulder region material into the wedge bore using an agent that undergoes a solid-liquid phase transition but the shoulder material does not. Sufficient softening or melting of the bonding material occurs such the wedge retraction again ensues.

In an alternative formulation, the phase change material is employed such that it is initially in intimate contact with fastener or constructed as part of the fastener. The three above methods (i.e., shape memory alloy as shoulder, melting material as shoulder, melting attachment material between fastener and bore) again may be utilized. Here, a permanent shoulder exists inside the bore of the final wedge segment. Either part of the fastener itself (e.g., the head of the fastener is the 'material', or the 'material' is used to bond the head to the fastener shank, or the entire fastener itself is made of the 'material'), or an intermediate device between the fastener-shoulder bearing surface (e.g., a washer) employs the material. Upon phase change the fastener load is again removed and wedge retraction ensues.

Figure 11A:
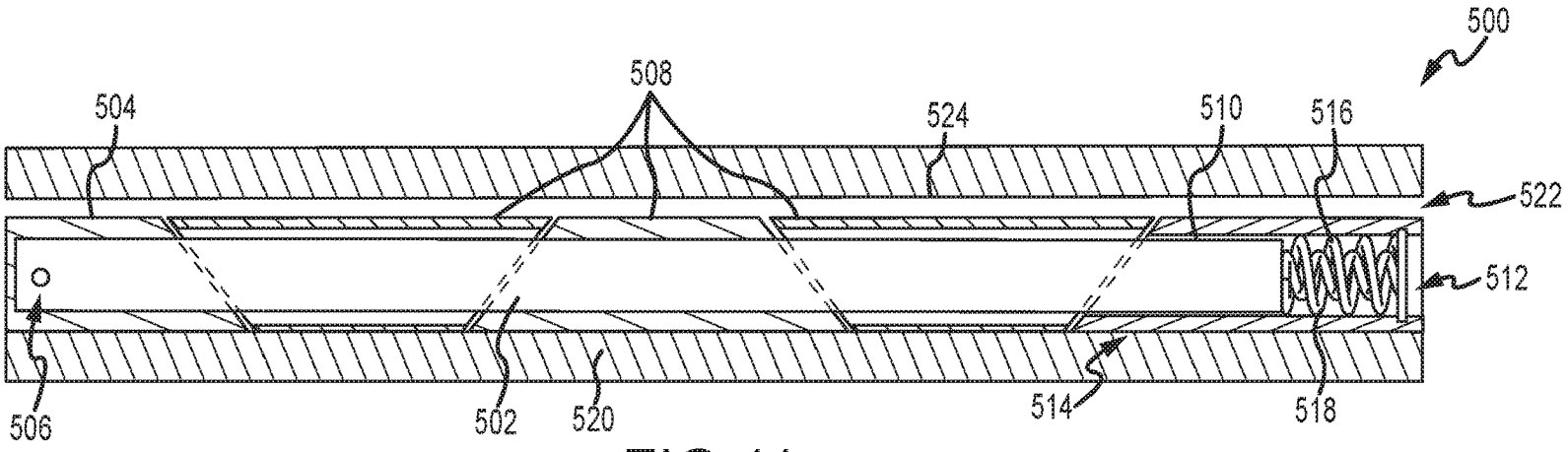
FIGS. 11*a* and 11*b* are sectional side of an embodiment of a bi-directional heat switch in thermally insulating and thermally conducting states, respectively.
Figure 11B:
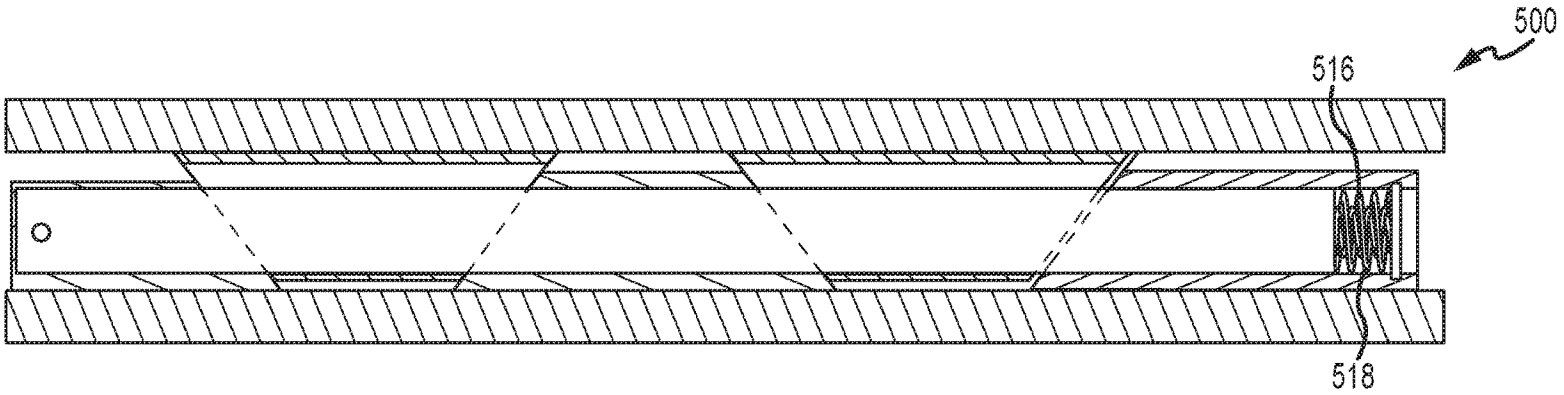

Referring now to FIGS. 11*a*-11*b*, an embodiment of a wedge-based heat switch 500 is configured as "bi-directional", "dual-spring", and "SMA" from FIG. 4. The bi-directional switch may be used for thermal management of satellite payloads. Here, system design often requires thermal isolation from the structure when the satellite is in the Earth's shadow in order to maximize self-generated heat to maintain devices above low temperature limits. However, once subject to solar loading, design typically requires that devices be well sunk to the structure to minimize internal temperatures on sensitive devices.

Wedge-based heat switch 500 comprises a shaft 502, a plurality of thermally conductive wedge segments mounted on the shaft with one wedge segment 504 pinned via pin 506 to the end of the shaft and the remaining interior wedge segments 508 and a final wedge segment 510 configured such that they can move with respect to each other.

The shaft 502 fits into a bore 512 in the final wedge segment 510. A two-spring system 514 is mechanically affixed at one axial end to the shaft 502 and at the opposing axial end to the final wedge segment 510. At least one of the springs 516, 518 in the two-spring system consists of a shape memory alloy. In the isolated state with the wedge segments radially contracted, one spring 516 is in tension and the other spring 518 is in compression and the two-spring system 514 is in equilibrium. Zero net force is applied to the final wedge segment 510 but the expanded position is maintained since deviation would yield a counteracting force from the spring system. In the expanded position, the wedge segments are in thermal contact with a first surface or structure 520 but form an air gap 522 with a second surface or structure 524.

At the specified solid-solid phase change temperature, the shape memory alloy spring(s) 516, 518 change shape yielding a net spring force acting on the final wedge segment 510 directed toward the pinned end of the shaft. This force promotes axial retraction of the wedge segments enabling wedging action to close the air gap 522 to the second surface or structure 524. Returning back to and crossing the specified solid-solid phase change temperature reverts the shape change and the two-spring system 514 returns to the equilibrium state, the wedges axially expand and the radial air gap 522 to the structure again forms.

The shape memory alloy spring(s) 516, 518 may be either the one that is in compression or tension when the two-spring system is in the equilibrium state. If the shape memory spring is in compression with the system in equilibrium, then it weakens upon shape change so that the force exerted by the opposing spring is greater. If the shape memory spring is in tension with the system in equilibrium, then it strengthens upon shape change so that the force exerted by the opposing spring is weaker. The two spring forces are equal in the equilibrium state, and cancel due to the opposing axial directions of action. In the off-equilibrium state, the spring forces are no longer equal and the difference in spring force is used to load the wedges, which translate the force into the radial direction to apply it to the surfaces to be thermally connected, creating contact pressure at the interfaces. The change in spring force in the shape memory alloy spring(s) is chiefly due to a change in the free length, and hence a change in the length deviation from the free length, to which the spring force is proportional. Depending on alloy selection, a change in the material spring constant may also occur.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A wedge-based heat switch, comprising:

a plurality of thermally conductive wedge segments aligned on a shaft pinned at one end to one of the wedge segments and extending into a longitudinal bore of a final wedge segment, said wedge segments configured to transmit axial motion of the wedge segments along the shaft into radial displacement of at least one wedge segment to contract or expand the plurality of wedge segments to make or break thermal contact between first and second surfaces to provide a thermally conducting state or a thermally insulating state;

one or more springs positioned between the shaft and the final wedge segment and entirely contained within the final wedge segment, said springs configured to store energy through compression or expansion along the shaft to provide a force to produce axial motion of the wedge segments including the final wedge segment along the shaft; and a phase transition material positioned entirely between the shaft and the final wedge segment and entirely contained within the final wedge segment, said phase transition material configured to activate based on a temperature stimulus to release the energy stored in the one or more springs.

2. The wedge-based heat switch of claim 1, wherein the phase transition material is one of a shape memory alloy (SMA), a controlled melt material, or a temperature-dependent adhesive.

3. The wedge-based heat switch of claim 1, wherein the phase transition material is configured as a switchable shoulder region on a final wedge segment that acts as a bearing surface and a fastener that threads into the shaft and seats on the switchable shoulder region of the final wedge segment to react a mechanical preload of the fastener, wherein upon activation of the phase transition material the switchable shoulder region adapts such that the bearing surface no longer carries the load, which releases the stored energy producing axial motion of the fastener and wedge segments to contract or expand the plurality of wedge segments.

4. The wedge-based heat switch of claim 3, wherein the heat switch is configured as a thermally conducting to thermally insulating unidirectional switch, wherein a portion of the mechanical preload serves to overcome a compression of the energy storage element to contract the plurality of wedge segments to make thermal contact between the first and second surfaces and a remaining portion of the mechanical preload creates a contact pressure at the first and second surfaces to establish the thermally conducting state, wherein upon activation of the phase transition material the energy storage element expands to axially expand the wedge segments to break thermal contact and form an airgap to establish the thermally insulating state.

5. The wedge-based heat switch of claim 4, wherein a plurality of said wedge-based heat switches are positioned in a missile between an airframe and electronics within the airframe, wherein the wedge-based heat switches are positioned between the electronics and an outer skin of the airframe, wherein heating of the airframe during missile flight serves to activate the phase transition material to make or break contact between the first and second surfaces on the electronics and the outer skin of the airframe to provide a thermally conducting state or a thermally insulating state.

6. The wedge-based heat switch of claim 3, wherein the heat switch is configured as a thermally insulating to thermally conducting unidirectional switch, wherein the mechanical preload extends the energy storage element to store energy, wherein the wedge segments are expanded axially to break thermal contact and form an airgap to establish the thermally insulating state, wherein upon activation of the phase transition material the energy storage element contracts to contract the plurality of wedge segments to make thermal contact between the first and second surfaces and create a contact pressure at the first and second surfaces to establish the thermally conducting state.

7. The wedge-based heat switch of claim 3, wherein the phase transition material forms a collar around the fastener to define the switchable shoulder region, wherein the fastener seats on collar to react the mechanical preload, upon activation of the phase transition material the collar adapts such that the bearing surface no longer carries the load.

8. The wedge-based heat switch of claim 3, wherein the fastener includes a detent, wherein the phase transition material forms a spring clip located in the switchable shoulder region of the final wedge segment that locks into the fastener detent to react the mechanical preload, upon activation of the phase transition material the spring clip adapts such that the bearing surface no longer carries the load to disengage the fastener.

9. The wedge-based heat switch of claim 1, wherein the heat switch is a bi-directional switch including an opposing pair of co-axial springs, at least one of which comprised of the phase transition material, positioned inside the longitudinal bore of the final wedge segment and mechanically affixed between the un-pinned end of the shaft and the final wedge segment, one of which stores energy in compression and one of which stores energy in expansion, wherein said opposing energy storage elements are in equilibrium with said wedge segments expanded axially to form an air gap to define the thermally insulating state, upon activation of the phase transition material the spring that applies axial force acting in a direction that loads the wedge segments becomes dominant to overcome the opposing axial force of the opposing spring and contract the plurality of wedge segments to make thermal contact between the first and second surfaces and create a contact pressure at the first and second surfaces to establish the thermally conducting state.

10. A wedge-based heat switch, comprising:

a plurality of thermally conductive wedge segments aligned on a shaft, a switchable shoulder region on a final wedge segment that acts as a bearing surface and a fastener that threads into the shaft and seats on the shoulder region of the final wedge segment to react a mechanical preload of the fastener, said wedge segments configured to transmit axial motion of the wedge segments along the shaft into radial displacement of at least one wedge segment to contract or expand the plurality of wedge segments to make or break thermal contact between first and second surfaces to provide a thermally conducting state or a thermally insulating state;

one or more springs positioned between the shaft and the final wedge segment and entirely contained within the final wedge segment, said one or more springs configured to store energy through compression or expansion along the shaft to provide a force to produce axial motion of the wedge segments along the shaft; and a phase transition material positioned entirely between the shaft and the final wedge segment and entirely contained within the final wedge segment, said phase transition material configured to form the switchable shoulder region to passively activate based on a temperature stimulus to release the energy stored in the one or more springs, wherein upon activation of the phase transition material the switchable shoulder region of the final wedge segment adapts such that the bearing surface no longer carries the load, which releases the stored energy producing axial motion of the fastener and wedge segments to contract or expand the plurality of wedge segments.

11. The wedge-based heat switch of claim 10, wherein the phase transition material is one of a shape memory alloy (SMA), a controlled melt material, or a temperature-dependent adhesive.

12. A missile, comprising:

an airframe including an inner volume that houses electronics and an outer skin, said airframe configured for a net heat flow out through the outer skin pre-flight and in through the outer skin during flight; and a wedge-based heat switch positioned between the electronics and the outer skin that is configured to provide a thermally conducting path between the electronics and the outer skin pre-flight and to passive switch when an operating temperature exceeds an activation temperature during flight to provide a thermally insulating path including an air gap between the electronics and the outer skin, said wedge based heat switch comprising, a plurality of thermally conductive wedge segments aligned on a shaft, a switchable shoulder region on a final wedge segment that acts as a bearing surface and a fastener that threads into the shaft and seats on the shoulder region of the final wedge segment to react a mechanical preload of the fastener, said wedge segments configured to transmit axial motion of the wedge segments along the shaft into radial displacement of at least one wedge segment to contract or expand the plurality of wedge segments to make or break thermal contact between first and second surfaces to provide a thermally conducting state or a thermally insulating state;

one or more springs positioned between the shaft and the final wedge segment and contained entirely within the final wedge segment, said one or more springs configured to store energy through compression or expansion along the shaft to provide a force to produce axial motion of the wedge segments including the final wedge segment along the shaft, wherein a portion of the mechanical preload serves to overcome a compression of the spring to contract the plurality of wedge segments including the final wedge segment to make thermal contact between the electronics and the outer skin and a remaining portion of the mechanical preload creates a contact pressure at the first and second surfaces to establish the thermally conducting state; and a phase transition material positioned between the shaft and the final wedge segment and contained entirely within the final wedge segment, said phase transition material configured to form the switchable shoulder region to activate based on a temperature stimulus to release the energy stored in the one or more springs, wherein activation of the phase transition material causes the shoulder region of the final wedge segment to adapt such that the bearing surface no longer carries the load, which releases the stored energy producing axial motion of the fastener and wedge segments to contract or expand the plurality of wedge segments including the final wedge segment, wherein activation of the phase transition material allows the spring to expand to axially expand the wedge segments including the final wedge segment to break thermal contact and form an air gap to establish the thermally insulating state.

13. The missile of claim 12, wherein the phase transition material is one of a shape memory alloy (SMA), a controlled melt material, or a temperature-dependent adhesive, and wherein the one or more energy storage elements comprise one or more springs.

14. A wedge-based bi-directional heat switch, comprising:

a plurality of thermally conductive wedge segments aligned on a shaft pinned at one end to one of the wedge segments and extending into a longitudinal bore of a final wedge segment, said wedge segments configured to transmit axial motion of the wedge segments along the shaft into radial displacement of at least one wedge segment to contract or expand the plurality of wedge segments to make or break thermal contact between first and second surfaces to provide a thermally conducting state or a thermally insulating state; and an opposing pair of co-axial springs positioned inside the longitudinal bore of the final wedge segment and mechanically affixed between the un-pinned end of the shaft and the final wedge segment, one of which stores energy in compression and one of which stores energy in expansion, at least one said spring formed from a phase transition material configured to activate based on a temperature stimulus to release energy stored in that spring, wherein said opposing pair of springs are in equilibrium with said wedge segments including the final wedge segment expanded axially to form an air gap to define the thermally insulating state, upon activation of the phase transition material the spring that applies axial force acting in a direction that loads the wedge segments becomes dominant to overcome the opposing axial force of the opposing spring and contract the plurality of wedge segments including the final wedge segment to make thermal contact between the first and second surfaces and create a contact pressure at the first and second surfaces to establish the thermally conducting state.

* * * * *